United States Patent [19]

Brown

[11] Patent Number: 4,534,531

[45] Date of Patent: Aug. 13, 1985

[54] ELONGATED PROP FOR SUPPORTING A LOAD

[76] Inventor: Allan H. G. Brown, 35 Marilyn St., Klerksdorp, South Africa

[21] Appl. No.: 283,157

[22] Filed: Jul. 14, 1981

[30] Foreign Application Priority Data

Jul. 22, 1980 [ZA] South Africa ..... 80/4400

[51] Int. Cl.[3] ..... F16M 13/00

[52] U.S. Cl. ..... 248/351; 248/357; 248/548

[58] Field of Search ..... 248/351, 356, 357; 52/98; 220/72, 71

[56] References Cited

U.S. PATENT DOCUMENTS

| | | | |
|---|---|---|---|
| 1,471,124 | 10/1923 | Handl | 405/250 |
| 1,528,034 | 3/1925 | Thielmann | 248/357 |
| 1,642,603 | 9/1927 | Conway | 248/351 |
| 1,759,786 | 5/1930 | Hardin | 405/250 |
| 1,996,401 | 4/1935 | Bowen | 52/301 |
| 2,701,449 | 2/1955 | Young | 405/250 |
| 3,372,552 | 3/1968 | Liddell | 52/728 X |
| 4,283,449 | 8/1981 | Damminger | 52/DIG. 7 X |

FOREIGN PATENT DOCUMENTS

| | | | |
|---|---|---|---|
| 13821 | of 1929 | Australia | 248/351 |
| 505019 | 8/1930 | Fed. Rep. of Germany | 248/351 |
| 854483 | 11/1952 | Fed. Rep. of Germany | 248/351 |
| 2114413 | 9/1972 | Fed. Rep. of Germany | 248/356 |
| 457567 | 9/1913 | France | 248/351 |
| 712661 | 10/1931 | France | 248/354.1 |
| 758922 | 1/1934 | France | 248/351 |
| 155716 | 8/1956 | Sweden | 248/351 |
| 114640 | 9/1917 | United Kingdom | 248/351 |
| 118969 | 9/1918 | United Kingdom | 248/548 |
| 219263 | 7/1924 | United Kingdom | 248/354.7 |
| 288011 | 4/1928 | United Kingdom | 248/351 |
| 319107 | 9/1929 | United Kingdom | 248/351 |
| 430595 | 6/1935 | United Kingdom | 248/354.2 |

*Primary Examiner*—J. Franklin Foss
*Assistant Examiner*—Sarah A. Lechok
*Attorney, Agent, or Firm*—Young & Thompson

[57] ABSTRACT

A prop made from an elongate timber element. The cross-sectional area of the element is reduced in at least one region e.g. by tapering the element, forming circumferential grooves in it, or boring holes axially or transversely into or through the element. The region of reduced cross-section is reinforced by means of bands or a sleeve which extends circumferentially around at least part of the region. The reduced cross-sectional area promotes deformation of the prop and the reinforcement controls the rate of deformation.

6 Claims, 17 Drawing Figures

ELONGATED PROP FOR SUPPORTING A LOAD

Figure 1:
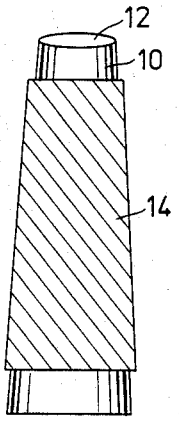

This invention relates to a prop which is particularly suitable for underground use.

According to the invention a prop comprises an elongate support member the cross sectional area of which is reduced in at least one region, and means reinforcing at least part of the region.

The support member may be made of any suitable material e.g. foamed concrete, a plastics material or any other moulded or cast material but preferably is timber.

The reinforcement means may similarly be made from any suitable material but in the interests of economy and strength and predictable properties of yield under load it is preferred that the reinforcement means is made from a metal such as aluminium or spring or mild steel, a plastics material which may be moulded and which may be of nylon, polycarbonate, ASB, or any other plastics material which has adequate strength and which can be treated or processed so as to be non-inflammable, or a reinforced resinous material. The reinforcement may for example comprise fibre glass, metal, polypropylene or some other plastics, material. Preferably use is made of a filamentary reinforcing material which is disposed helically or in a plurality of hoop windings around the support member. A preferred material in this respect is glass fibre reinforced resin.

In one form of the invention the reinforcement means comprises a sleeve which is engaged with the region. The sleeve may be preformed and subsequently fitted to the support member. Alternatively the sleeve may be formed in situ around the region. The sleeve may be complementary in shape to at least part of the region.

In a different form of the invention the reinforcement means comprises a plurality of bands located around the support member and spaced from one another. Again it is possible to preform the bands and then locate them around the support member or to form the bands in situ on the support member.

The cross sectional area of the support member may be reduced by removing material from at least the outer longitudinal surface of the support member. This may be done by forming notches or other discontinuous formations in the outer surface. Alternatively one or more circumferentially extending grooves are formed in the outer surface. The size of each groove and its shape may be varied according to requirements and the spacing between adjacent grooves may similarly be varied. Thus the grooves could be semi-circular, triangular or rectangular in cross section. The grooves could be fairly long i.e extend over a substantial distance in the axial direction and relatively shallow i.e. of a substantially smaller dimension in the radial direction.

In another variation the support member is tapered at least at one end. The tapered end may be frustro-conical. The taper may extend over a portion of the length of the support member with the remainder of the length of the support member untouched or untreated in any other way. The support member may be tapered at both ends, again with each end frustro-conical, or it may be tapered over at least a greater part of its length. In all instances a plurality of bands may be applied to the tapered portion or portions or complementary sleeves e.g. of filamentary wound fibre glass or mild steel which are preformed may be applied to the taper or else may be formed in situ around the taper.

It is also possible to form the support member with at least one end which is at least partly cylindrical and which is of reduced cross sectional area.

In another form of the invention the support member is formed with one or more holes extending from the outer longitudinal surface in to the support member. The holes may extend through the support member transversely to its longitudinal axis. Again a preformed sleeve or a sleeve formed in situ or a plurality of spaced bands may be applied to the support member enclosing at least some of the holes.

The cross sectional area of the support member may alternatively or additionally be reduced by removing material in the longitudinal direction from at least one end of the support member. Thus the support member may be formed with at least one longitudinally extending hole, or an annular hole, in at least one of its ends.

The invention has three preferred embodiments which have generally been described in the preceding passage. In the first embodiment the prop comprises an elongate timber support member which is tapered over at least part of its length and which has at least one frustro-conical end and reinforcement means which extends circumferentially around at least part of the taper.

In the second preferred embodiment the prop comprises an elongate timber support member with a plurality of holes which are transverse to its longitudinal axis and which extend into or through the support member and reinforcement means which extends circumferentially around the support member in the region of the holes.

In the third embodiment the prop comprises an elongate timber support member with a plurality of circumferentially extending grooves spaced axially from one another, and reinforcement means which extends circumferentially around the support member enclosing at least some of the grooves.

In each of the three embodiments, as previously stated, the reinforcement means may consist of a plurality of bands which are spaced from each other. Alternatively the reinforcement means may comprise a sleeve around the support member. In the first embodiment the reinforcement means comprises a frustro-conical sleeve while in the other embodiments the reinforcement means comprises a sleeve which is generally circular cylindrical. In all instances the reinforcement means is preferably made from a reinforced resinuous material such as filamentary glass fibre reinforced resin, a plastics material which may be moulded or a suitable metal such as aluminum or mild steel.

The invention also provides a method of making a prop which includes the steps of reducing the cross sectional area of an elongate timber support member in at least one region and reinforcing at least part of the region by means which extends circumferentially around at least part of the region.

The reinforcing may be achieved by locating a sleeve around at least part of the region or by locating a plurality of spaced apart bands around at least part of the region.

The cross sectional area may be reduced by removing material from at least the outer longitudinal surface of the support member or alternatively or additionally by removing material in the longitudinal direction from at least one end of the support member.

The invention is described by way of non-limitating examples illustrated in the accompanying drawings. It will be apparent from a perusal of the drawings that the invention may be put into practice in many different forms and clearly not all such forms have been illustrated. Other examples of the invention which are covered by the concepts herein described are intended to fall within the scope of the claims of this specification.

The accompanying drawings, FIGS. 1 to 17, all schematically illustrate props according to the invention in elevation.

FIGS. 1 to 4 illustrate props according to the invention which are made from an elongate timber element 10 which is tapered over at least the greater portion of its length and which has a frustro-conical end 12.

In each case the element 10 is reinforced. In FIG. 1 a sleeve 14 is applied to it. The sleeve is tapered or frustro-conical and leaves clear portions of timber at each of its ends. The sleeve could of course alternatively extend over the entire length of the timber. The sleeve may be preformed of metal or of filamentary glass fibre reinforced resin or may alternatively be formed in situ by winding a resin coated filamentary material around the timber element.

Figure 2:
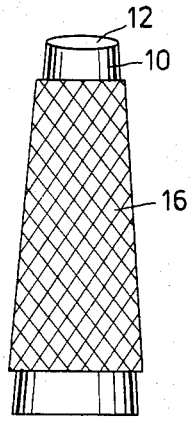

The prop of FIG. 2 has a sleeve 16 around it but in this instance the sleeve is apertured and has a plurality of holes in it being formed for example from perforated sheet metal or from a mesh material.

Figure 3:
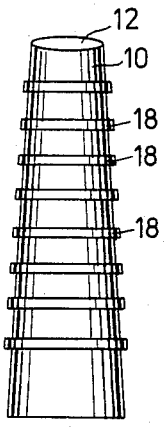

In the prop of FIG. 3 a plurality of spaced apart bands 18, preformed or formed in situ of metal or glass fibre or any other suitable material, are located around the timber element 10. The advantage of the bands is that tolerances need not be as tightly maintained as with the props of FIGS. 1 and 2 for the bands being of relatively narrow width automatically settle on the timber element 10 in regions of corresponding diameters.

Figure 4:
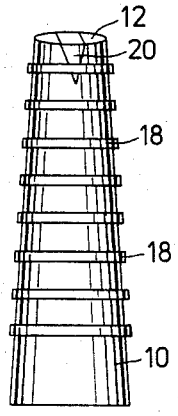

The props of FIGS. 1 and 3 when loaded axially in use deform progressively from the smaller diameter ends 12. On the one hand the reduction of cross sectional area promotes deformation of the timber and ensures that it deforms before the prop can snap. In other words a guaranteed yielding action is obtained. On the other hand the reinforcement whether it be a sleeve or a plurality of bands controls the deformation and ensures that a desired yield to load characteristic is obtained. In certain instances it may be necessary nonetheless to take further steps to ensure that deformation results before snapping or other abrupt breakage of the prop. One way of achieving this is illustrated in FIG. 4 which shows that any of the props shown in FIGS. 1 to 3 may be formed with a V shaped segment 20 at the end 12. Under loading the segment moves axially penetrating the remainder of the timber and causing it to split but against the action of the reinforcement.

Figure 5:
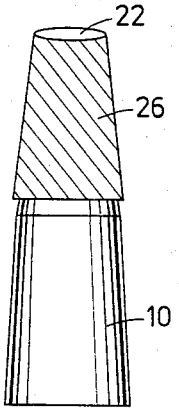
Figure 6:
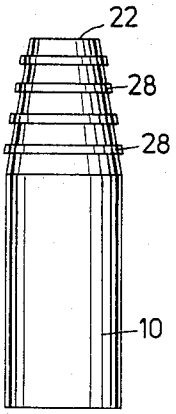
Figure 7:
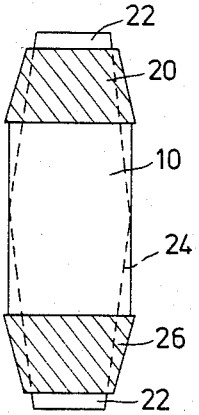

FIGS. 5 to 7 illustrate embodiments of a second preferred form of the invention. In FIGS. 5 and 6 the timber element 10 has a single relatively short tapered end 22 while in FIG. 7 both ends of the element 10 are so tapered. Referring to FIG. 7 the tapering could be along dotted lines 24 so that the timber is tapered substantially over its entire length in two directions.

In each case the frustro-conical end 22 has reinforcing applied to it. In FIG. 5 the reinforcing consists of a sleeve 26 which may be of mild steel, a suitable moulded plastics material or a filamentary reinforced resinuous material, a preferred material being filamentary glass fibre in resin. The sleeves may be preformed or be formed in situ. In FIG. 6 the reinforcing consists of a plurality of bands 28 spaced from one another and extending circumferentially around the frustro-conical end. In FIG. 7 the reinforcing consists of two frustro-conical sleeves 26.

Whereas the props of FIGS. 1 to 4 will generally yield in use over substantially the entire length the props of FIGS. 5 to 7 are designed to provide a limited yield only. In many instances a limited yield is satisfactory e.g. where mining operations in a particular region are not long lasting. The provision of such props means that the cost of providing support is reduced. The principle of operation is similar to that already described in that the weakened regions of the timber elements deform under axial load, preventing abrupt breakage of the timber elements, but the reinforcement prevents uncontrolled disintegration of the timber.

Figure 8:
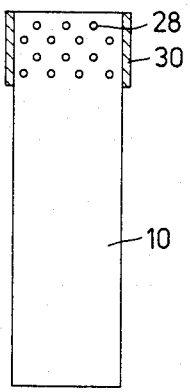
Figure 9:
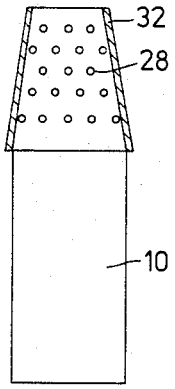
Figure 10:
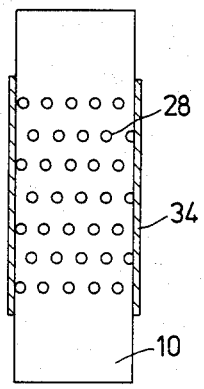

FIGS. 8 to 10 illustrate props according to another preferred form of the invention. In each case the timber element 10 is formed with a plurality of holes 28 transversely to its longitudinal axis. The holes may be formed into the timber element or alternatively extend through the timber element. In FIG. 8 the holes are at one end of the element and are enclosed by means of a reinforcing sleeve 30. The sleeve is generally circular cylindrical. In FIG. 9 a frustro-conical sleeve 32 is located around the holes 28. In FIG. 10 a large number of holes is formed over the greater part of the length of the timber element and an elongate circular cylindrical sleeve 34 is located around the timber element enclosing substantially all the holes. In each instance the holes 28 weaken the timber and ensure progressive collapse of the timber element when axially loaded. The range of deformation with the prop of FIG. 10 is greater than in the other two cases. The sleeves in each case stiffen the prop and prevent it from breaking in the weakened region. The action achieved with the prop of FIG. 9 is slightly different from that in the other two cases in that the sleeve 32 compresses the timber to some extent in the radial direction while the timber itself is collapsed simultaneously in the axial direction.

The sleeve 32 will generally be made of a stiff material such as steel while the sleeves 30 and 34 may be made of metal such as mild steel or filamentary wound glass fibre reinforced resin.

Figure 11:
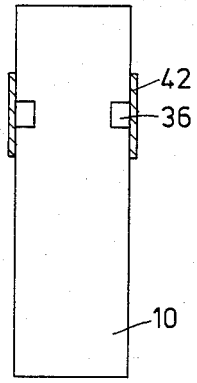
Figure 12:
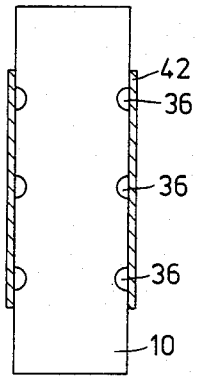
Figure 13:
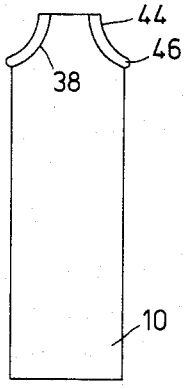
Figure 14:
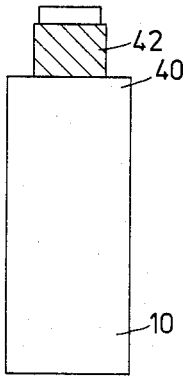

FIGS. 11 to 14 illustrate props according to another preferred form of the invention. In each case circumferentially extending grooves 36 are formed in the outer surface of the timber element. In FIG. 11 a single groove 36 is so formed. In FIG. 12 a number of grooves 36 spaced apart from each other in the axial direction are so formed. The grooves may be equally spaced from one aother or their spacing may vary. Similarly the characteristics of each groove may be varied. Thus its dimension in the axial direction and its depth in the radial direction may be varied and its cross sectional shape may also be varied. Suitable cross sectional shapes are rectangular, triangular or arcuate e.g. semicircular. In FIGS. 13 and 14 the grooves 36 are formed at one end of the timber element 10 and the net result is that in these cases the end of the element has a generally cylindrical shape of reduced diameter. In FIG. 13 the cylinder extends with a sloping surface 38 to the normal diameter while in FIG. 14 the end has a generally flat annular section 40.

In accordance with the principles of the invention in each instance the weakened region of reduced cross sectional area has reinforcing applied to it. In FIGS. 11, 12 and 14 the reinforcing consists of a generally circular cylindrical sleeve 42 while in FIG. 13 the reinforcing consisting of a sleeve 44 with a flared base 46. Again it should be mentioned that the sleeve may be made of any suitable material e.g. metal such as mild steel, plastics or a reinforced resinuous material. The principle of operation is similar to that described in that under axial loading the weakened region deforms first, before abrupt breakage of the prop can occur, and the reinforcement limits the deformation and prevents uncontrolled disintegration of the timber.

Figure 15:
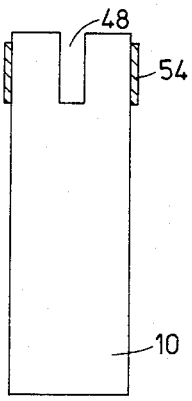
Figure 16:
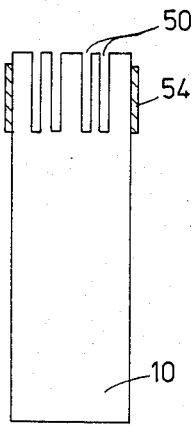
Figure 17:
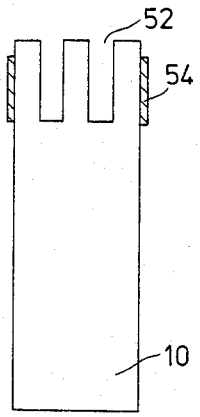

FIGS. 15 to 17 illustrate props where the reduction of cross sectional area of the timber element is achieved by removing material in the longitudinal direction from at least one end of the timber element and not, as in the previous examples, by removing material from the outer longitudinal surface. Although a distinction is made between these two methods of reducing the cross sectional area it may well be possible to combine the methods to arrive at a desired characteristic. In FIG. 15 a central hole 48 is bored axially into one end of the element 10. In FIG. 16 a plurality of axial holes 50 are formed into the element. In FIG. 17 an annular groove 52 is formed in one end of the element 10. In each case a sleeve 54 surrounds the weakened region. Operation of these props is identical to that of the other props in that under axial loading the weakened regions deform but are restrained from uncontrolled distintegration by the reinforcing action of the sleeves 54.

In some of the examples of the props described only one end of the timber element has been reduced in cross section and reinforced. Clearly both ends can be similarly treated. The props have been described as being made of timber and this is preferred from the point of view of economy but other materials such as foamed concrete or plastics materials may also be used. The reinforcing has generally been described as being either mild steel or filamentary glass fibre reinforced resin but again it is possible to use any suitable material. In particular it will be desirable in many cases to use moulded plastics materials which exhibit the desired degrees of strength and corrosion resistance. The use of moulded reinforcement will considerably lower the cost of the props.

The invention thus provides a prop which is weakened by reducing its cross sectional area in at least one region. The region may be fairly short or alternatively extend over the entire length of the prop as with FIGS. 1 to 4. The weakened region is then reinforced by means of bands or a sleeve. The weakened regions deform before breakage of the prop results, under axial loading, and the reinforcement controls the deformation process thereby providing a desired yield to load characteristic. Many examples of the invention have been illustrated but there are all based on the stated concept of operation. Clearly many other examples and forms of the invention can be produced but these are all intended to fall within the scope of the following claims.

I claim:

1. An elongated prop for supporting a load applied longitudinally comprising an elongated substantially cylindrical solid support member having at least one region of reduced cross-sectional area formed in it when unconstrained, and substantially cylindrical reinforcement means that is shorter than the prop and that has insignificant load carrying properties in the longitudinal direction and that encircles the support member over at least part of the region of reduced cross-sectional area, there being at least one void in the support member and surrounded by the reinforcement means into which the support member can collapse under load, the arrangement of the reinforcement means on the support member being such that, in use, the load will be applied to the end faces of the support member, the reinforcement means being spaced from both ends of the prop and therefore subject substantially to radial forces only without bearing any substantial part of the vertical load.

2. A proper according to claim 1, wherein said support member is a timber.

3. A prop according to claim 1, wherein the region of reduced cross-sectional area is at one end of the support member.

4. A prop according to claim 2, wherein at least one longitudinally extending bore is formed in said end of the support member to form the region of reduced cross-sectional area.

5. A prop according to claim 1, wherein the region of reduced cross-sectional area includes at least one bore extending from the outer longitudinal surface into the support member.

6. A prop according to claim 5, wherein the region of reduced cross-sectional area includes at least one hole extending through the support member transversely to its longitudinal axis.

* * * * *